US006438847B1

(12) United States Patent
Alsaifi

(10) Patent No.: US 6,438,847 B1
(45) Date of Patent: Aug. 27, 2002

(54) DISPOSABLE DOUBLE BLADE STRAIGHT RAZOR

(76) Inventor: Saad Mobarak Alsaifi, P.O. Box 232, Al Fentas (KW)

( * ) Notice: Subject to any disclaimer, the term of this patent is extended or adjusted under 35 U.S.C. 154(b) by 0 days.

(21) Appl. No.: 09/484,894

(22) Filed: Jan. 18, 2000

(51) Int. Cl.[7] ..... B26B 21/06; B26B 21/10
(52) U.S. Cl. ..... 30/53; 30/50
(58) Field of Search ..... 30/30, 32, 47, 30/50, 53, 54, 528

(56) References Cited

U.S. PATENT DOCUMENTS

| | | | | | |
|---|---|---|---|---|---|
| 1,137,976 | A | * | 5/1915 | Hyde | 30/53 |
| 1,450,859 | A | * | 4/1923 | Kulhawy | 30/32 |
| 2,817,897 | A | * | 12/1957 | Meohas | 30/53 |
| 2,952,910 | A | * | 9/1960 | Meohas | 30/53 |
| 3,255,523 | A | * | 6/1966 | Robertson et al. | 30/53 |
| 4,622,742 | A | | 11/1986 | Lee | |
| 4,920,644 | A | | 5/1990 | LaGattuta | |
| 5,009,003 | A | * | 4/1991 | Grange | 30/53 |
| 5,343,622 | A | * | 9/1994 | Andrews | 30/50 |
| 5,649,364 | A | | 7/1997 | Ilanlou | |
| 6,082,007 | A | * | 7/2000 | Andrews | 30/50 |

FOREIGN PATENT DOCUMENTS

| | | |
|---|---|---|
| FR | 2 704 797 | * 10/1994 |

* cited by examiner

*Primary Examiner*—Hwei-Siu Payer
(74) *Attorney, Agent, or Firm*—Thomas R. Vigil; Welsh & Katz, Ltd.

(57) ABSTRACT

The disposable straight razor comprises: an elongate body; a double razor blade assembly mounted in the body; the body being molded about the double razor blade assembly; the double razor blade assembly extending outwardly from the body a distance of from approximately 0.5 mm to approximately 4 mm; and a cover for the body and the double razor blade assembly which extends over the body and completely over the double razor blade assembly.

20 Claims, 4 Drawing Sheets

DISPOSABLE DOUBLE BLADE STRAIGHT RAZOR

BACKGROUND OF THE INVENTION

1. Field of the Invention

The present invention relates to a disposable straight razor having double (two) razor blades for use in barber shops and by hairdressers.

2. Description of the Prior Art

Presently available shaving devices and razor blades used therein typically include a body and a razor blade which is periodically changed while keeping the body of the device for further use.

The shaving device of this type is exposed to various contamination factors during the process of changing blades such as may result from any wounds that might have taken place during the prior shaving use.

This can lead to the contamination of the shaving device per se, which in turn can cause infection and may cause the transfer of different diseases from one infected person to another healthy person. Infections are now very serious and include skin diseases in addition to the more serious diseases, which are carried by skin and blood, such as staphococus, hepatitis Virus B and C and AIDS.

Heretofore, several disposable straight razors have been proposed and examples of same are disclosed in the following U.S. Patents.

| U.S. Pat. No. | Patentee |
|---|---|
| 4,622,742 | Lee |
| 4,920,644 | LaGattuta |
| 5,649,364 | Ilanlou |

SUMMARY OF THE INVENTION

An object or feature of the present invention is to provide a disposable straight razor having at least two blades for shaving which is light weight and easy to use in barber shops and by hairdressers.

Another object or feature of the present invention is to provide a disposable straight razor having a body molded about at least two razors blades for shaving with a highly safety factor that ensures non transmission of diseases and microbes from one infected person to another healthy person together together with a smooth shave in an easy and safe manner.

Another object of the invention is to provide a disposable straight razor having at least two razor blades fixed in a body which does not need blade replacement or changing and accordingly does not need to be touched by the user whereby infections are not transmitted to the user himself.

Still another object of the present invention is to provide a disposable straight razor having at least two razor blades for fine shaving which is effected twice first by a middle blade and then by an outer blade thereby to provide a very fine shaving.

According to the teachings of the present invention there is provided a disposable straight razor comprising: an elongate body; a double razor blade assembly mounted in the body; the body being molded about the double razor blade assembly; the double razor blade assembly extending outwardly from the body a distance of from approximately 0.05 mm to approximately 4 mm; and a cover for the body and the double razor blade assembly which extends over the body and completely over the double razor blade assembly.

DESCRIPTION OF THE PREFERRED EMBODIMENT(S)

Figure 1:
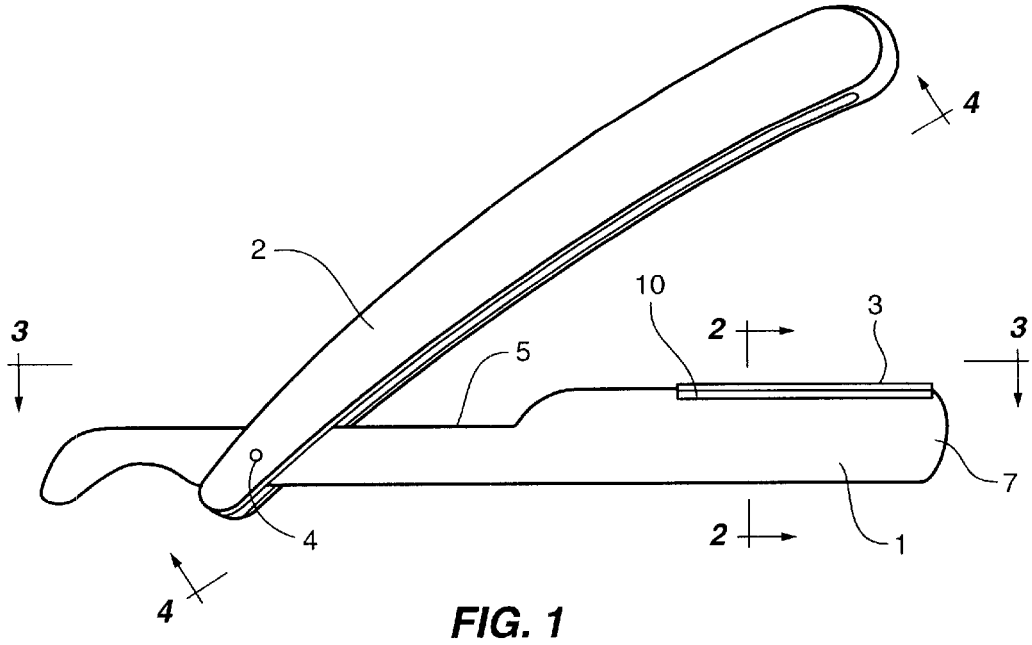
FIG. 1 is a plan view of one embodiment of the disposable straight razor of the present invention.

In FIG. 1 there is illustrated a plan view of a disposable straight razor constructed according to the teachings of the present invention. The disposable double edge straight razor 1 comprises two sections, the first section being a body 7 of the straight razor 1 with a double razor blade assembly 3 fixed therein, and the second section being a cover 2 for the disposable straight razor 1 which is coupled to the body 7 and can act as a balance for the straight razor 1 when it is held in a user's hand. The two sections 2 and 7 are connected by a screw 4 which can be made from any suitable material, e.g., a plastic or a metal.

It should be noted that a surface 5 of the disposable straight razor is rough or serrated and is not smooth in order to prevent sliding of the disposable straight razor in the hand of the user and to allow maximum control of the straight razor during use to get the best shaving result in the shortest possible time.

Figure 2:
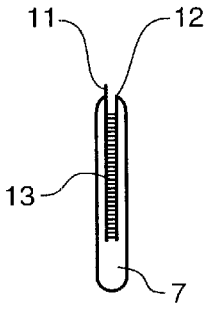
FIG. 2 is a sectional view through the body of the disposable straight razor shown in FIG. 1 and is taken along line 2—2 of FIG. 1.

FIG. 2 is a cross-section of the body 7 and the double razor blade assembly 3 shown in FIG. 1. The double blade razor assembly 3 is fixed in the body 7 so that it cannot be detached or removed or replaced. The double razor blade assembly 3 comprises a higher or upper blade 11 and lower, outer blade 12. There is a space 8 between the upper edges of the blades 11 and 12 and spacing material 13 between the two blades 11 and 12. The distance between the two blades is between approximately 0.5 mm and approximately 2 mm. Also, the lower blade 12 can have the body 7 molded up to the upper edge of the lower, outer blade 12 as shown in FIG. 2 and the upper edge even can be a smooth continuation of the side of the body 7.

Figure 3:
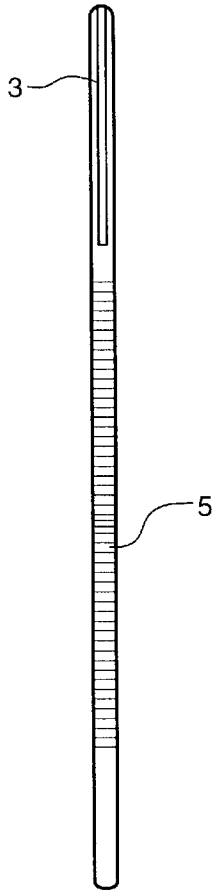
FIG. 3 is a top plan view of the body of the disposable straight razor shown in FIG. 1 and is taken along line 3—3 of FIG. 1.

FIG. 3 is a top plan view of the body 7 of the disposable straight razor 1 shown in FIG. 1 and shows the double razor blade assembly 3 with the two blades 11 and 12 and the rough or serrated surface 5 on an upper edge of the body 7 adjacent the double razor blade assembly 3 mounted in the body 7.

It is to be noted that the double razor blade assembly 3 is fixed in the body 7 of the disposable straight razor 1 so that it cannot be detached or removed and so that the upper blade 11 projects above an upper edge 10 of the body 7 by approximately 0.5 mm to approximately 4 mm, and preferably between 1 and 2 mm for providing smooth fine shaving. The higher or upper blade 11 projects between approximately 0.5 mm and approximately 2 mm above the lower, outer blade 12. The distance between the blades 11 and 12 is in the range of between approximately 0.5 mm and aproximately 2 mm and is maintained by the normally plastic, spacing material 13.

Figure 4:
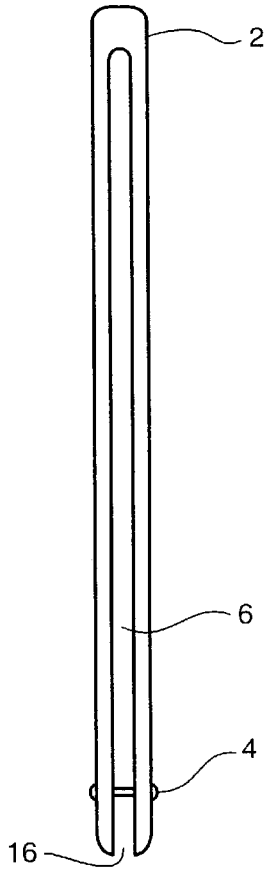
FIG. 4 is bottom plan view of the cover for the disposable straight razor shown in FIG. 1 and is taken along line 4—4 of FIG. 1.

FIG. 4 is a bottom or underside view of the cover 2 and shows a slot or cavity 16 which receives the double blade assembly and at least part of the body 7 of the disposable straight razor 1 and shows the position of the screw 4 forming a pivot axis for the cover 2 and a cover stopper rod 6 which extends across the cover 2 and serves to stop movement of the cover 2 against the body 7 of the disposable razor 1.

The cover 2 serves to cover the double razor blade assembly 3 and serves as a handle to facilitate the use of the disposable straight razor 1.

Figure 5:
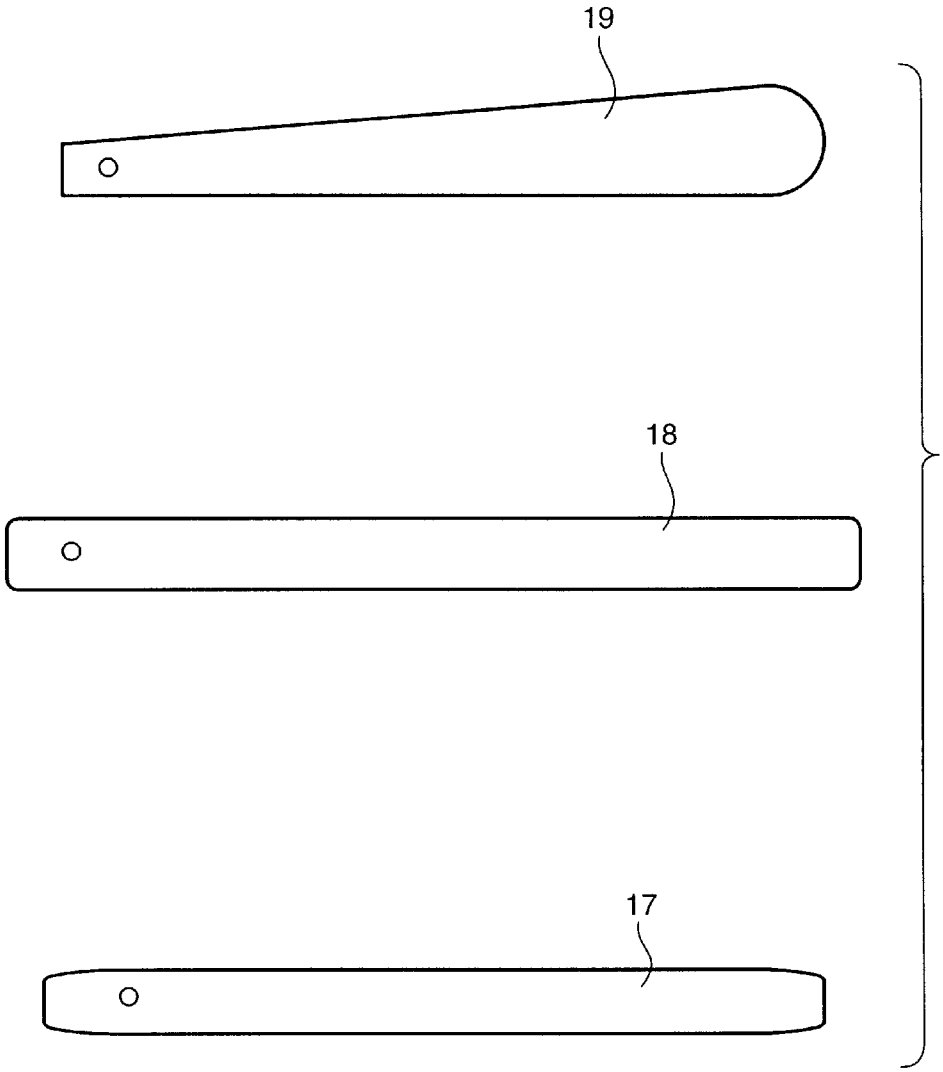
FIG. 5 illustrates three shapes of the cover or handle extension for the straight razor shown in FIG. 1.

As shown in FIG. 5, the cover 2 may have any shape other than the shape shown in FIG. 1, e.g. the shapes 17, 18 and 19 shown in FIG. 5, although the shape of the cover 2 is not to be limited to the shapes shown in the drawings.

Figure 6:
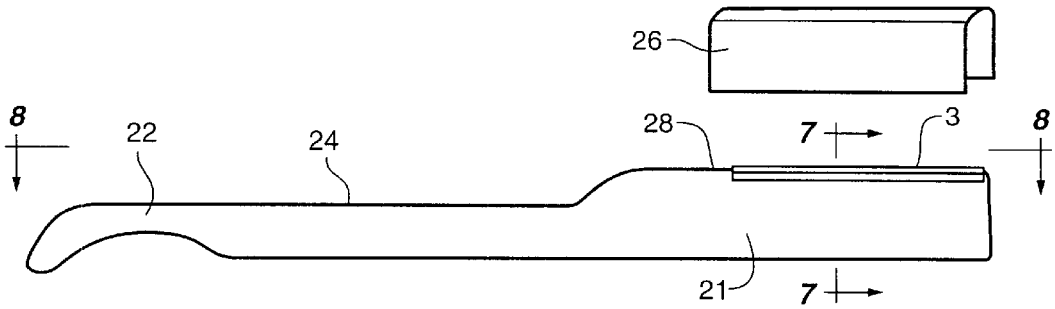
FIG. 6 is a plan view of another embodiment of the disposable straight razor of the present invention.

FIG. 6 illustrates another embodiment of a straight razor 21 of the present invention. In this embodiment, a curved razor handle 22 is integral with a body 24 having a double razor blade assembly 3 mounted in the body 24. In this embodiment, a separate, plastic, elongate, inverted U-shaped cover 26 is provided which is not connected to the body 24. Here the straight razor 21 and the double razor blade assembly 3 mounted in the body 24 of the straight razor 21 are one simple piece easy to handle and use with a disposable plastic cover 26.

It is to be noted that the double razor blade assembly 3 is fixed in the body 24 of the disposable straight razor 21 so that it cannot be detached or removed and so that the upper blade 11 projects above an upper edge 28 of the body 24 by approximately 0.5 mm to approximately 4 mm, and preferably between 1 and 2 mm for providing smooth fine shaving. The higher or upper blade 11 projects between approximately 0.5 mm and approximately 2 mm above the lower, outer blade 12 by 0.5–2 mm . The distance between the blades 11 and 12 is in the range of between approximately 0.5 mm and aproximately 2 mm and is maintained by the normally plastic, spacing material 13.

Figure 7:
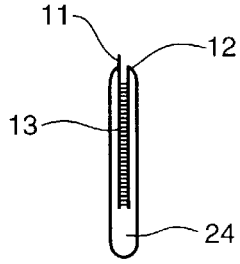
FIG. 7 is a sectional view through the body of the disposable straight razor shown in FIG. 6 and is taken along line 7—7 of FIG. 6.

FIG. 7 is a sectional view of the body 24 shown in FIG. 6 and is similar to the sectional view shown in FIG. 2 and shows the body 24, the double razor blade assembly 3, the higher or upper blade 11, the lower outer blade 12 and the spacing material 13.

Figure 8:
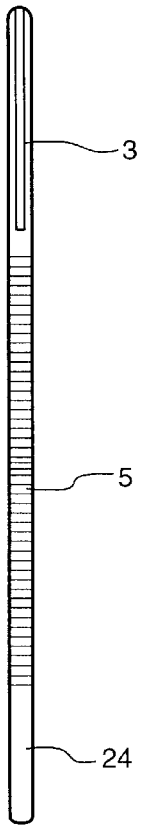
FIG. 8 is a top plan view of the body of the disposable straight razor shown in FIG. 6 and is taken along line 8—8 of FIG. 6.

FIG. 8 is a top plan view of the body 24 shown in FIG. 6 and is similar to the top plan view shown in FIG. 3 and shows the double razor blade assembly 3 and the rough or serrated surface 5.

Figure 9:
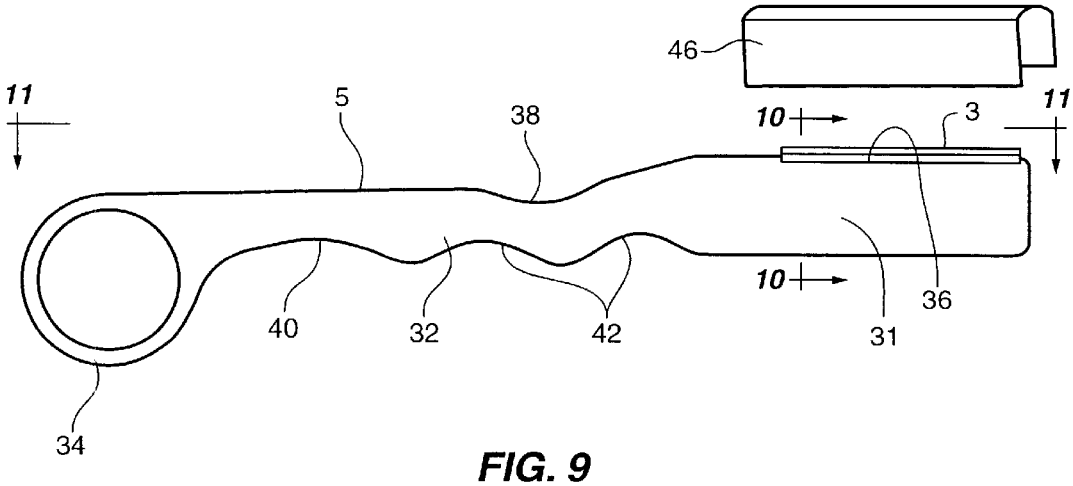
FIG. 9 is a plan view of still another embodiment of the straight razor of the present invention.

FIG. 9 illustrates still another embodiment of a straight razor 31 having a body 32 constructed according to the teachings of the present invention. The straight razor 31 represents a slight variation of the straight razor 21 shown in FIG. 6. In this respect, the variation resides in the shape of the body 32 of the straight razor 31 which has a ring shaped handle portion 34 and an upper edge 36 having the double razor blade assembly 3 mounted therein and having a notch 38 for receiving a finger or thumb. Also, a lower edge 40 of the body 32 has finger receiving notches 42 for facilitating gripping of the body 32 and handle portion 34. The double razor blade assembly 3 is identical to the double razor blade assembly 3 shown in FIGS. 1, 6 and 9 and the simple plastic cover 46 is identical to the cover 26 shown in FIG. 6.

It is to be noted that the double razor blade assembly 3 is fixed in the body 32 of the disposable straight razor 31 so that it cannot be detached or removed and so that the upper blade 11 projects above an upper edge 28 of the body 24 by approximately 0.5 mm to approximately 4 mm, and preferably between 1 and 2 mm for providing smooth fine shaving. The higher or upper blade 11 projects between approximately 0.5 mm and approximately 2 mm above the lower, outer blade 12 by 0.5–2 mm . The distance between the blades 11 and 12 is in the range of between approximately 0.5 mm and aproximately 2 mm and is maintained by the normally plastic, spacing material 13.

Figure 10:
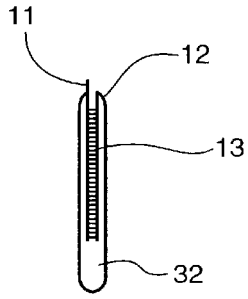
FIG. 10 is a sectional view through the body of the disposable straight razor shown in FIG. 9 and is taken along line 10—10 of FIG. 9.

FIG. 10 is a sectional view of the body 32 shown in FIG. 9 and is similar to the sectional view shown in FIG. 2 and shows the body 32, the double razor blade assembly 3, the higher or upper blade 11, the lower outer blade 12 and the spacing material 13.

Figure 11:
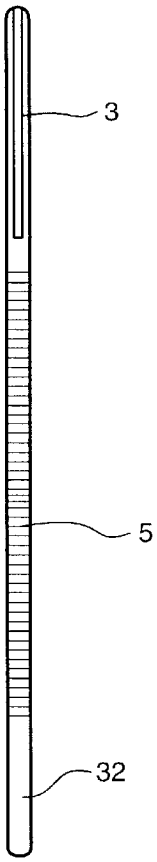
FIG. 11 is a top plan view of the body of the disposable straight razor shown in FIG. 9 and is taken along line 11—11 of FIG. 9.

FIG. 11 is a top plan view of the body 32 shown in FIG. 9 and is similar to the top plan view shown in FIG. 3 and shows the double razor blade assembly 3 and the rough or serrated surface 5.

The straight razor 1, 21 or 31 can be made from different materials e.g., plastic, stainless steel, aluminum, wood etc. However, in one preferred embodiment of the straight razor of the present invention the body 7, 24 or 32 is made from plastic, as it is cheap, light weight and easy to handle.

In the manufacture of the straight razor 1, 21 or 31, a mold having the required shape for the body 7, 24 or 32 is made and plastic is injected into the mold. It should be noted that injection of the plastic is made after first fixing the razor blade 3 to project out from an edge of the body 7, 24 or 32 to be molded by the distance specified above, namely 0.5 to 4 mm and preferably 1 to 2 mm so that the razor 3 forms part of the one piece body 7, 24 or 32 whereby the razor blade 3 cannot be removed from the straight razor 1, 21 or 31.

From the foregoing description, it will be understood that the disposable straight razors 1, 21 or 31 of the present invention have a number of advantages, some of which have been described above and others of which are inherent in the invention.

Also, it will be understood that modifications can be made to the disposable straight razors 1, 21 or 31 of the present invention without departing from the teachings of the invention.

Accordingly, the scope of the invention is only to be limited as necessitated by the accompanying claims.

I claim:

1. A disposable straight razor comprising: an elongate body; a double razor blade assembly mounted in said body; said body being molded about said double razor blade assembly; said double razor blade assembly extending outwardly from said body a distance of from approximately 0.5 mm to approximately 4 mm; and a cover for said body and said cover extending over said body and completely over said double razor blade assembly, said body including a handle portion, said cover being pivotally connected to said handle portion of said body and said cover having an elongate slot with a width sufficient to cover the double razor blade assembly and said body in which said double razor blade assembly is mounted.

2. The disposable straight razor of claim 1 wherein the surface of said body has one of a rough texture or serrations to prevent sliding of said body in a hand of a user to provide for maximum control of the straight razor during use.

3. The disposable straight razor of claim 1 wherein said double razor blade assembly projects out of said body a distance from approximately 1 mm to approximately 2 mm.

4. The disposable straight razor of claim 1 wherein said handle portion has a curved free end.

5. The disposable straight razor of claim 1 wherein said handle portion has a free end in the shape of a ring for receiving a finger.

6. The disposable straight razor of claim 1 wherein said handle portion has at least one curved finger or thumb-receiving notch on a side edge of said body mounting said razor blade assembly.

7. A disposable straight razor comprising: an elongate body; a double razor blade assembly mounted in said body; said body being molded about said double razor blade assembly; said double razor blade assembly extending outwardly from said body a distance of from approximately 0.5 mm to approximately 4 mm; and a cover for said body, said cover extending over said body and completely over said double razor blade assembly, said body being molded around said double razor blade assembly to provide a one piece straight razor, said cover being pivotally connected to said body and having a slot therein.

8. The disposable straight razor comprising: an elongate thin body having spaced apart flat sides and opposite edges; a double razor blade assembly mounted in said body; said body being molded about said double razor blade assembly; said double razor blade assembly extending outwardly from said body a distance of from approximately 0.5 mm to approximately 4 mm; a cover for said body, said cover extending over said body and completely over said double razor blade assembly to provide a one piece straight razor, said cover being a separate plastic cover and said double razor blade assembly comprising a higher, upper blade and a lower outer blade and said blades being spaced from each other.

9. The disposable straight razor of claim 8 wherein the upper edge of said upper blade is spaced above the upper edge of said lower blade a distance of between approximately 0.5 mm and approximately 2 mm.

10. The disposable straight razor of claim 8 wherein said upper blade is spaced laterally from said lower blade a distance of between approximately 0.5 mm and approximately 2 mm.

11. The disposable straight razor of claim 8 wherein said body is molded up to the upper edge of the lower, outer blade whereby said upper edge of said lower blade is a smooth continuation of the side of said body.

12. The disposable straight razor of claim 8 wherein said body includes a handle portion having a curved free end.

13. The disposable straight razor of claim 8 wherein said body includes a handle portion having a free end in the shape of a ring for receiving a finger.

14. The disposable straight razor of claim 8 wherein said body includes a handle portion which has at least one curved finger or thumb-receiving notch on a side edge of said body mounting said razor blade assembly.

15. A disposable straight razor comprising: an elongate thin body having spaced apart flat sides and opposite edges; a double razor blade assembly mounted in said body and extending from one edge thereof; said body being molded about said double razor blade assembly; said double razor blade assembly extending outwardly from said one edge of said body a distance of from approximately 0.5 mm to approximately 4 mm; and a cover for said body and said double razor blade assembly which extends over said elongate body and completely over said double razor blade assembly.

16. The disposable straight razor claim 15 wherein said double razor blade assembly comprises a higher, upper blade and a lower, outer blade and and said blades being spaced apart and extending from said one edge.

17. The disposable straight razor of claim 16 wherein the upper edge of said upper blade is spaced above the upper edge of said lower blade a distance of between approximately 0.5 mm and approximately 2 mm.

18. The disposable straight razor of claim 15 wherein said body includes a handle portion having a curved free end.

19. The disposable straight razor of claim 15 wherein said body includes a handle portion having a free end in the shape of a ring for receiving a finger.

20. The disposable straight razor of claim 15 wherein said body includes a handle portion which has at least one curved finger or thumb-receiving notch on a side edge of said body mounting said razor blade assembly.

* * * * *